US005759232A

United States Patent [19]

Takahashi et al.

[11] Patent Number: 5,759,232

[45] Date of Patent: Jun. 2, 1998

[54] METHOD OF CHARGING MATERIALS INTO CUPOLA

[75] Inventors: Yukio Takahashi; Shuji Takeuchi; Nagayasu Bessho, all of Chiba, Japan

[73] Assignee: Kawasaki Steel Corporation, Japan

[21] Appl. No.: 814,484

[22] Filed: Mar. 10, 1997

[30] Foreign Application Priority Data

Mar. 18, 1996 [JP] Japan ..... 8-060600

[51] Int. Cl.[6] ..... C21B 5/00

[52] U.S. Cl. ..... 75/469; 266/44; 266/176; 266/900

[58] Field of Search ..... 266/44, 900, 176; 75/469

[56] References Cited

U.S. PATENT DOCUMENTS

| | | | |
|---|---|---|---|
| 783,044 | 2/1905 | Johnson, Jr. | 75/469 |
| 1,948,695 | 2/1934 | Brassert | 75/469 |
| 3,429,463 | 2/1969 | Blau et al. | 266/176 |
| 3,594,154 | 7/1971 | Kanokogi | 75/469 |
| 3,652,069 | 3/1972 | Worner | 266/176 |
| 4,033,562 | 7/1977 | Collin | 266/900 |
| 4,556,418 | 12/1985 | Syska | 266/900 |

FOREIGN PATENT DOCUMENTS

| | | |
|---|---|---|
| 870 480 | 3/1953 | Germany . |
| 41 39 236 A1 | 5/1993 | Germany . |
| 8-219644 | 8/1996 | Japan . |
| WO 87/07705 | 12/1987 | WIPO . |

*Primary Examiner*—Scott Kastler
*Attorney, Agent, or Firm*—Austin R. Miller

[57] ABSTRACT

A method of charging an iron scrap melting cupola with iron scrap and coke enables the iron scrap to be melted with high energy efficiency. The charging pipe feed is set at a level "h" which meets the condition of $h \leqq (r-r') \tan\theta$, and iron scrap of a quantity Ws meeting the condition of $Ws \leqq \frac{1}{3}\cdot\pi r^3\cdot\tan\theta\cdot\rho_s$ is charged through the charging pipe, followed by charging of coke, wherein h represents the height of the charging feed above the material in the cupola (meters), r represents the inside radius of the cupola (meters), r' represents the inside radius of the charging pipe (meters), θ represents the angle of repose of the iron scrap (degrees), Ws represents the quantity of iron scrap per cycle (kg/ch), and $\rho_s$ represents the bulk specific gravity of the iron scrap ($kg/m^3$).

3 Claims, 4 Drawing Sheets

METHOD OF CHARGING MATERIALS INTO CUPOLA

BACKGROUND OF THE INVENTION

1. Field of the Invention

The present invention broadly relates to a method of melting iron scrap by combustion of coke in a cupola and, more particularly, to a special method of charging a cupola to produce molten iron with higher thermal energy efficiency and to achieve a remarkably high secondary combustion ratio in the cupola.

2. Description of the Related Art

In addition to pig iron in the forms of hot molten iron and solidified pig iron, iron scrap is used as an iron source for the steelmaking process.

In recent years, recycling of iron scrap has gained in importance for prevention of environmental pollution, and for saving energy and for reduction of cost.

When molten iron reduced from iron ore is used as the iron source, a considerable amount of energy is consumed for the reduction of the oxide. In contrast, use of iron scrap as the iron source does not require such energy and accordingly saves on consumption of energy. In addition, iron scrap requires only simple pre-treatment as compared with other types of iron sources, allowing the size and cost of an entire plant to be reduced.

However, melting of iron scrap with electric energy in an arc furnace or induction heating furnace is disadvantageous from the viewpoint of energy consumption, because of the low energy conversion ratio inherent in electric power generation, which is generally as low as about 35%.

Cupolas are accordingly currently attracting attention as efficient and promising alternatives for melting iron scrap. Cupolas can operate with coke which provides an inexpensive heat source. In addition, the temperature of the exhaust gas can be reduced enough to improve thermal efficiency, provided the supply of scrap iron to the cupola is maintained above a certain required rate. Thus, the use of a cupola offers advantages both in operating cost and energy consumption.

Conventionally, however, the so-called secondary combustion ratio of a cupola has been quite low. This ratio ($CO_2 \times 100/(CO+CO_2)$), is calculated based on the composition of the exhaust gas from the top of cupola. In actual practice this ratio has been as low as about 40%. A proposal has been made in which air blowing tuyeres are arranged in separate stages so that CO gas generated in a primary air blowing stage is converted to $CO_2$ in a secondary air blowing stage. Such an improvement, however, has achieved only a small increase of the secondary combustion ratio, e.g., up to 50% or so at the highest. This is attributable to the occurrence of a so-called solution-loss reaction, which is expressed as $CO_2+C=2CO$, and which takes place when the $CO_2$ gas passes through the coke layer. This reaction wastefully consumes coke and hampers, due to large heat absorption, heating and melting of iron scrap, thus seriously impeding thermal efficiency of cupolas.

Japanese Unexamined Patent Publication No. 1-501401 discloses a cupola where the iron source and the, coke are charged in different positions from those used in conventional cupolas. More specifically, as shown in FIGS. 3A, and 3B of the drawings, the iron source is charged from the top of the furnace 11 of the cupola, while the coke is charged by means of feeders 13 which are above the hearth 12. Consequently, a bed composed of the iron source alone is formed in the furnace. The undesired solution loss reaction, therefore, does not take place in the furnace portion of the cupola. Consequently, this type of furnace offers an improved secondary combustion ratio and enables the thermal energy to be used more efficiently for the purpose of melting the iron source.

In FIGS. 3A and 3B of the drawings, the numeral 14 denotes a stack, 15 denotes tuyeres, 16 denotes a fuel bed, 17 denotes a recessed bottom, 18 denotes a conical protrusion and 19 denotes a refractory lining.

In the cupola shown in FIGS. 3A and 3B, however, the construction of the material charging apparatus on the top of the furnace is complicated as compared with those of the usual cupolas. In addition, the bed formed in the furnace portion 11 is composed solely of iron scrap which has small bulk density and which is easily softened and deformed or locally melted by the hot gas. This results in formation of aggregates of the molten scrap that are fused together to occur stock hanging which obstruct the flow of gas and hamper stable operation of the cupola.

Japanese Unexamined Patent Publication No. 7-70625 proposes a method of charging a cupola, wherein the distribution of the ferrous material over the cupola cross section is improved in order to suppress the solution loss reaction. As shown in FIGS. 4A and 4B, coke 6 is disposed in the peripheral zone along the furnace wall, while the iron scrap 7 is disposed in the core or central zone, in the region above primary tuyeres 20. When tuyeres are arranged in two stages, the upper tuyeres 21 are projected into the boundary zone between the coke 6 and the iron scrap 7, or even further into the core zone which is devoid of coke 6. In addition, this proposed method uses fine coke grains so that the resistance against the gas flowing through the coke bed is increased. Consequently, a major portion of the gas flows through the core, enhancing the thermal efficiency of the cupola by suppression of solution loss.

In FIGS. 4A and 4B, numerals 22 denote bed coke, 23 denotes a teeming outlet, 25 denotes a coke charging hopper, 26 denotes a waste gas pipe, and 27 denotes a partition plate.

Application of this proposed method to small-sized cupolas, however, encounters problems or difficulties. For instance, it is necessary to use finely granulated coke and iron scrap. The use of finely granulated coke and iron scrap tends to cause clogging of the gas passages, hampering stable operation of the cupola due to reduction of gas permeability. In order to avoid such clogging, it is necessary that the grain size distributions of the coke and iron scrap have to be delicately adjusted within limited ranges. This undesirably restricts freedom in selection of materials.

SUMMARY OF THE INVENTION

Accordingly, it is an object of the present invention to provide a method of charging a scrap-melting cupola with iron scrap and coke, with higher efficiency of use of thermal energy.

We have discovered that the failure of the conventional approaches toward improvement of the secondary combustion ratio can be overcome by controlling the patterns or manners in which the iron scrap and coke are charged into the cupola. By separately charging iron scrap and coke in the manner to be disclosed in detail hereinafter, it is now possible to provide a selective segregation between the zones of iron scrap and the zones of coke when viewed as a cross section of the cupola. We have discovered that the iron scrap can now be melted with high secondary combustion efficiency by maintaining a particular kind of segregation or demarcation.

According to the present invention, air blowing tuyeres are preferably provided at a lower portion of the cupola and the iron scrap and coke are charged from or near the top of said cupola. The method of this invention comprises controlling the level of introduction of the iron scrap charging location at or less than a height "h" which substantially satisfies the following equation (1), and limiting the amount of iron scrap per charge to a quantity Ws which substantially satisfies the conditions of the following equation (2); adjusting the charging pipe level upwardly and then charging the desired quantity of coke into the cupola, and repeating the adjustment of the level of the lower end of the charging pipe when charging iron scrap and when charging coke. The equations (1) and (2), for charging the iron scrap level and amount, are:

$$h \leqq (r-r') \tan \theta \quad (1)$$

$$Ws \leqq \tfrac{1}{3} \cdot \pi r^3 \cdot \tan \theta \rho_s \quad (2)$$

where the designations in the equations have the following meanings:

h: height of charge location above the surface of the material in the cupola, in meters r: inside radius of cupola (meters)

r': inside radius of charging pipe (meters)

θ: angle of repose of iron scrap (degrees)

Ws: quantity of iron scrap per charge (kg/ch)

$\rho_s$: bulk specific gravity of iron scrap (kg/m$^3$)

Preferably, the iron scrap and coke have maximum grain sizes which are not greater than about ⅓ the inside diameter of the furnace.

The above and other objects, features and advantages of the present invention will become clear from the following description, when read in conjunction with the accompanying drawings.

DESCRIPTION OF THE PREFERRED EMBODIMENTS

Figure 1A:
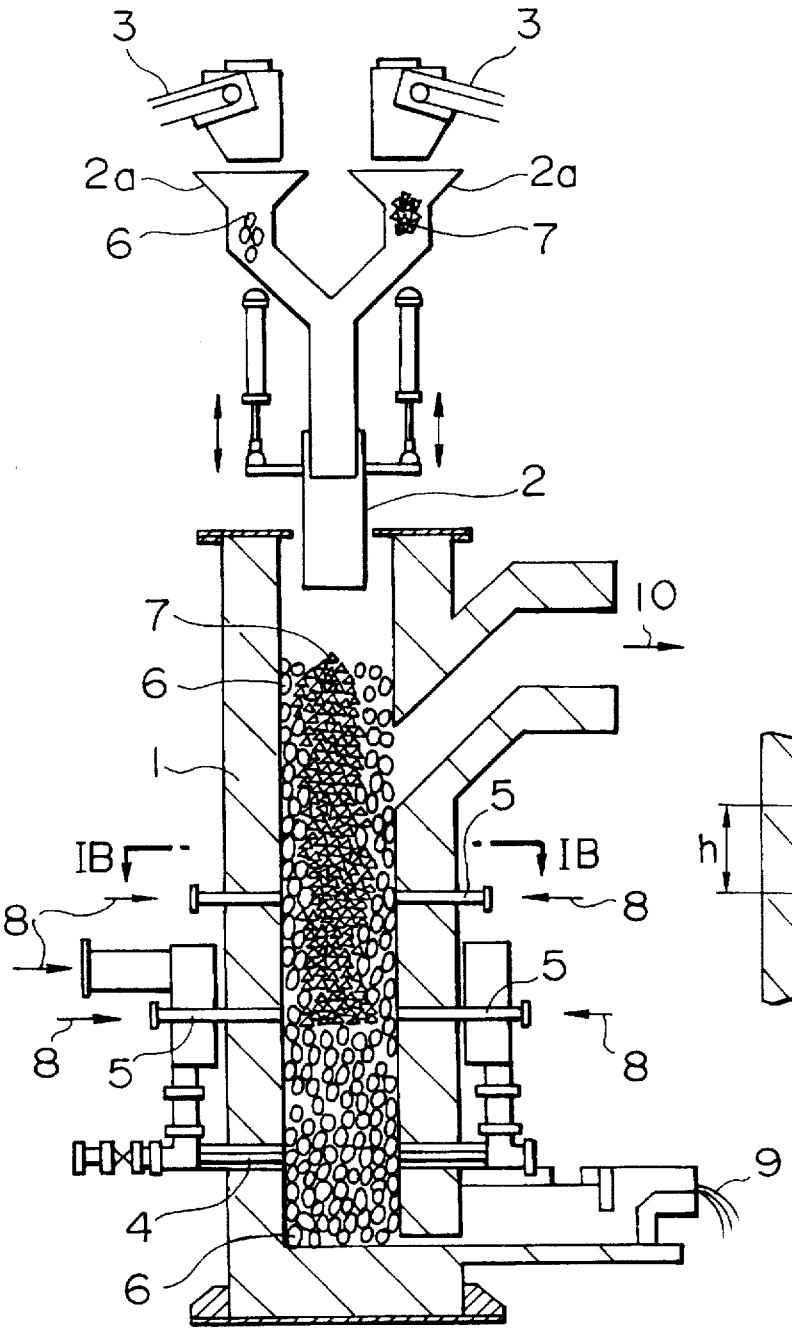
FIG. 1A is a view in side elevation of a cupola, partly in section, utilizing features of this invention and schematically illustrating the conditions and locations of the charges.

According to the present invention, iron scrap and coke are separately charged and controlled so that separate zones of iron scrap and separate zones of coke can be maintained across the cross section of the cupola.

The present invention can preferably be used in a cupola having at its lower portion multiple stages of air blowing tuyeres, as shown by way of example in FIG. 1. The particular cupola selected for illustration in FIG. 1 has tuyeres arranged in three stages. A charging pipe 2 or the equivalent charging location is provided at or near the top of the cupola, preferably adjustably positioned at the center of the cupola top, and is movable up and down, toward and away from the top and the bottom of the cupola, along the main axis of the cupola. Preferably, the charging pipe 2 has two hoppers 2a, 2a which respectively receive iron scrap 7 and coke 6 delivered by different belt conveyors 3, 3, respectively, so that the charging pipe 2 may be supplied separately with either the iron scrap 7 or the coke 6. The tuyeres include primary air-blowing tuyeres 4 for blowing air and secondary combustion tuyeres 5 which blow oxygen-enriched air 8 into the cupola, whereby the iron scrap is melted by the combustion heat of the coke to continuously form the molten iron 9.

In operation, an initial charge of coke is preferably laid on the hearth of the cupola to form a bed of coke. Then, the charging pipe 2 is vertically adjusted with its discharge end located at a level "h" above the top of the bed of coke which substantially meets the conditions of the following equation (1):

$$h \leqq (r-r') \tan \theta \quad (1)$$

where, h: height of charge location above the surface of the material in the cupola, (meters)

r: inside radius of cupola (meters)

r': inside radius of charging pipe (meters)

θ: angle of rest of iron scrap (degrees)

Then, iron scrap of a quantity Ws which substantially meets the conditions of equation (2) is charged into the cupola through the charging pipe 2. Equation (2) is:

$$Ws \leqq \tfrac{1}{3} \cdot \pi r^3 \cdot \tan \theta \cdot \rho_s \quad (2)$$

where,

Ws: quantity of iron scrap per cycle (kg/ch)

r: inside radius of cupola (meters)

θ: angle of repose of iron scrap (degrees)

$\rho_s$: bulk specific gravity of iron scrap (kg/m$^3$)

The iron scrap in the amount specified above is charged into the cupola through the charging pipe 2 with the lower end set at the height h specified above. A body or heap of iron scrap is thereby formed by gravity such that the top of the heap is located at about the center of the cupola, in accordance with its angle of repose θ, as shown in FIG. 1C. The body or heap of iron scrap cannot stably be well-formed in the manner shown in FIG. 1C if the lower end of the charging pipe is set at a level above the above-mentioned height "h". This is because falling iron scrap from a higher level would tend to flatten the heap, i.e., decrease the angle of repose of the iron scrap. Further, we have found that stable formation of the heap of iron scrap in the form shown in FIG. 1C cannot be achieved unless the quantity of iron scrap charged also satisfies the condition of equation (2). In order that the iron scrap and the coke are distributed with good separation or segregation between the iron scrap zone and the coke zone, it is essential that the level "h" and the amount Ws of iron scrap charged shall simultaneously meet the conditions of the equations (1) and (2).

The charging pipe is then elevated through a distance of about r' tan θ, and the requisite amount of coke for carburizing and melting is charged through the elevated charging pipe 2 or other suitable feed. Consequently, the coke 6 falls against the inclined surface of the heap of iron scrap, and is urged and stacked outwardly from the center of the heap of iron scrap 7 so as to be distributed out to and around the peripheral zone near the wall of the cupola, as will be seen from FIG. 1B.

Preferably, the pieces of iron scrap and coke are limited to a size not greater than about ⅓ the inside diameter of the cupola. The limitation of grain size is especially preferred in small-sized cupolas. It preserves the required gas permeation and distributes the iron scrap and the coke in such a manner as to form discrete zones of iron scrap and coke. Presence of pieces of iron scrap or coke greater than about ⅓ the inside diameter of the cupola would make it difficult to control the advantageous pattern of distribution of iron scrap and coke, and tends to hamper stable selective feeding and distribution of the respective charged materials from their respective charging locations.

Figure 1B:
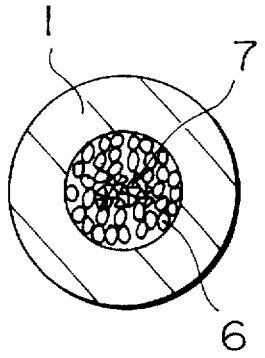
FIG. 1B is a sectional view taken as indicated by the lines and arrows IB—IB of FIG. 1A.
Figure 1C:
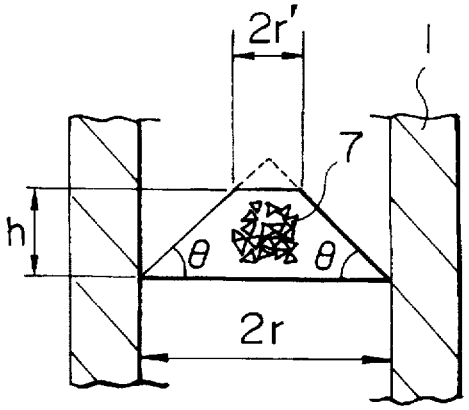
FIG. 1C is a schematic vertical sectional view illustrative of the conditions of the materials in the cupola after having conducted a material charging cycle.

The foregoing steps of selective charging of iron scrap and coke are repeated so that successive cone-shaped heaps of iron scrap and successive surrounding layers of coke are accumulated and built upwardly in the cupola in the manner indicated in FIGS. 1A, 1B and 1C. The segregation pattern, as between the iron scrap and coke, is such that a generally conical zone of iron scrap is formed in the core area or middle region of the cupola, while a zone of coke is built up peripherally in the area at and near the surrounding cupola wall. The charging pipe 2 can be adjusted to any desired level in accordance with the progress of the melting operation, by adjustable movement up or down along the cupola axis, for feeding iron scrap in accordance with the equations (1) and (2) heretofore described.

EXAMPLE 20 tons of iron scrap were melted in a cupola having an inside diameter of 0.6 m and a melting capacity of 3 ton/hr. Iron scrap used was shredded into grains or pieces of sizes ranging between 25 mm and 150 mm. Thus, the size of the greatest grain or piece of the iron scrap was less than ⅓ the cupola inside diameter.

Charging was conducted as follows: Coke was charged up to a level 1.1 m above the primary blowing tuyere to form a coke bed on the hearth. The charging pipe 2 was so adjusted that its lower end was positioned 0.09 m above the surface of the coke bed. The right side of the equation (1), i.e., $(r-r')\tan\theta$, is in this case 0.09 m, since the parameters r, r' and θ were respectively 0.3 m, 0.175 m and 35°. Thus, the above-mentioned level of the lower end of the charging pipe 2 met the condition of equation (1). The iron scrap was then charged. The quantity Ws of the iron scrap per charge was controlled at 25 kg. The right side of the equation (2), i.e., $\frac{1}{3}\cdot\pi r^3\cdot\tan\theta\cdot\rho_s$ was 25 in this case, as the parameters r, θ and $\rho_s$ were respectively 0.3 m, 35° and 1250 kg/m$^3$. Thus, the quantity of the iron scrap charged initially met the condition of equation (2).

Then, the charging pipe 2 was elevated by 0.35 m, and blast furnace coke as the carbon source, and limestone as a slag former, were charged through the elevated charging pipe 2. The quantity of coke charged at this time was determined to be 3.1 kg which was sufficient for melting the charged iron scrap to such an extent that the carbon content in the molten iron was 3.5 wt %.

Then, a second charge of the iron scrap was introduced in the manner heretofore described, all in accordance with the amount of iron scrap through a vertical height as used for the first charge of iron scrap, and was followed by charging of an additional charge of blast furnace coke and limestone, and the thus described sequence of charges was repeated until the level of the top surface of the charged material reached 3.5 m above the primary blowing tuyeres.

A supply of air was conducted through the tuyeres such that the total rate of oxygen supply both through the primary blowing tuyeres and the secondary combustion tuyeres was 378 Nm$^3$/hr. More specifically, oxygen-enriched air having an oxygen content of 23% was blown through the primary blowing tuyeres, while ambient air was supplied through the secondary combustion tuyeres, thus achieving a melting rate of 3 tons/hour.

Melting was thus continued while controlling the additional charges of the materials such that the top of the charged materials was maintained at a level falling within the range of 3.5±0.2 m. When an additional charge of the iron scrap was introduced during the melting operation, the charging pipe 2 was so adjusted that its lower end was held at a level "h" of 0.09 m above the materials present in the cupola, thus satisfying the condition of equation (1), whereas, when the blast furnace coke was charged, the charging pipe 2 was adjusted to set its lower end at a level of 0.35 meter above the charged materials.

In this manner the melting of iron scrap was performed at a coke consumption of 124 kg/ton, while achieving a high secondary combustion ratio of 87% as measured by analysis of the gas emanating from the top of the cupola.

A description will now be given of Comparative Examples outside the scope of this invention.

Comparative Example 1

20 tons of iron scrap were melted in a cupola having an inside diameter of 0.6 m and a melting capacity of 3 ton/hr. The charging pipe used in this case was fixed and not adjustable in the heightwise direction. Iron scrap used was shredded into grains or pieces of sizes ranging between 25 mm and 150 mm, while blast furnace coke of 30 to 75 mm was used as the carbon source. Thus, the sizes of the greatest grains or pieces of the iron scrap were less than ⅓ the cupola inside diameter.

Figure 2A:
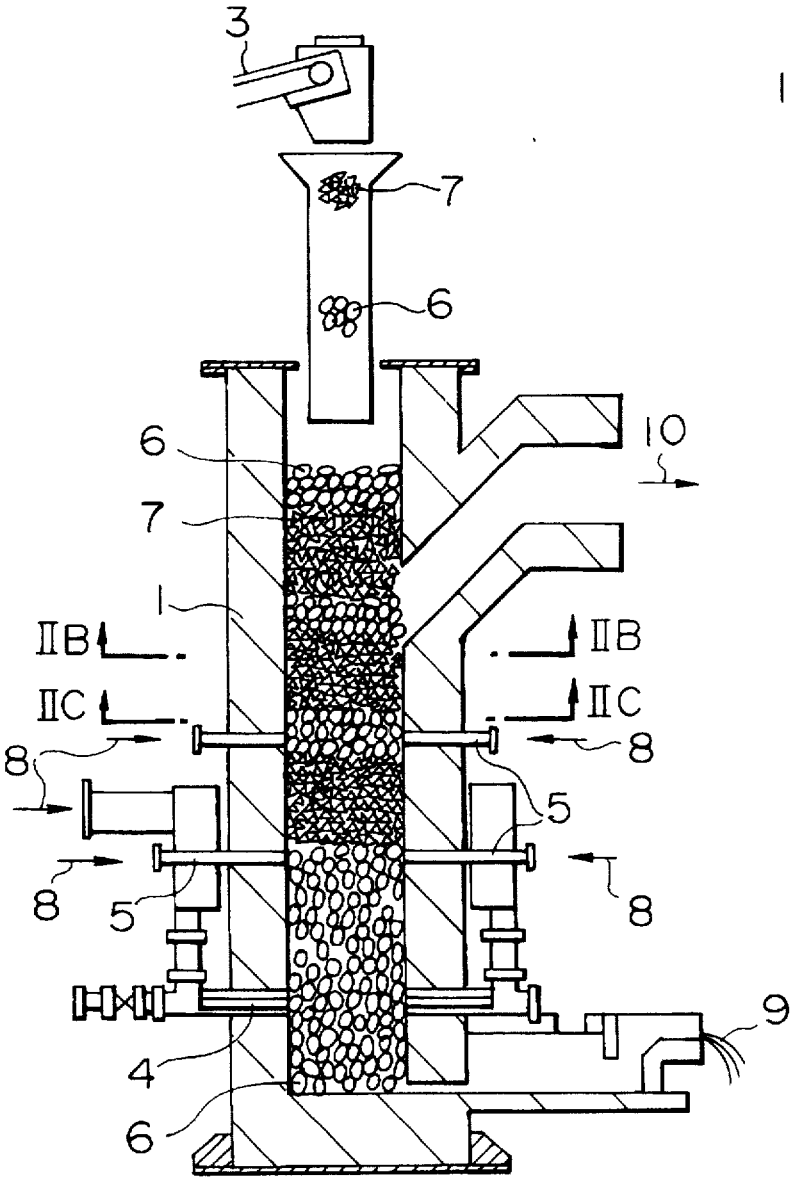
FIG. 2A is a view in side elevation, partly in section, like FIG. 1A but showing a comparative example instead.
Figure 2B:
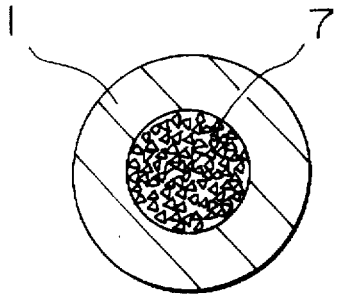
FIG. 2B is a view taken as indicated by the lines and arrows IIB—IIB of FIG. 2A.
Figure 2C:
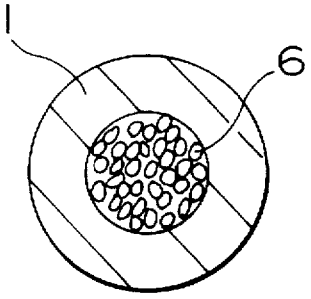
FIG. 2C is a view taken as indicated by the lines and arrows IIC—IIC of FIG. 2A.
Figure 3A:
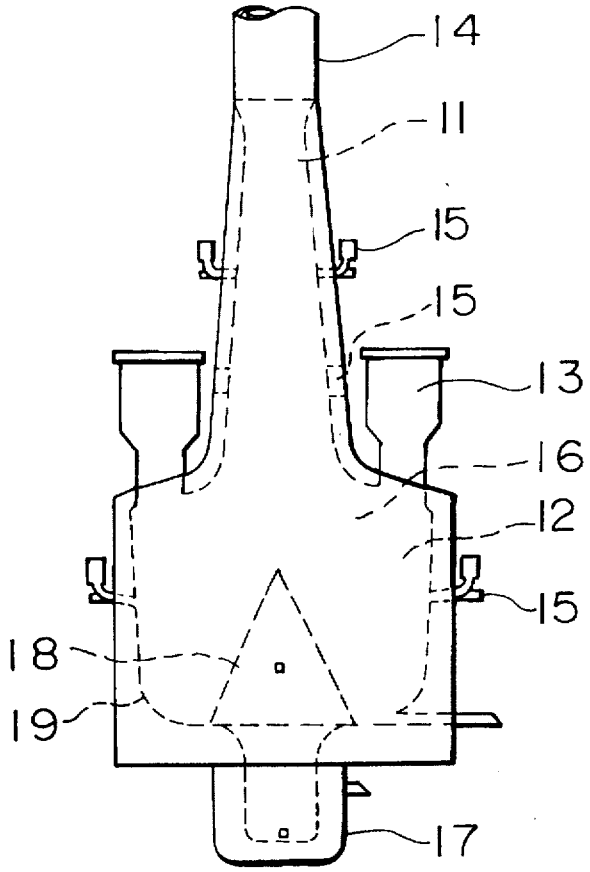
FIG. 3A PRIOR ART
FIG. 3A is a front elevational view of a conventional cupola.
Figure 3B:
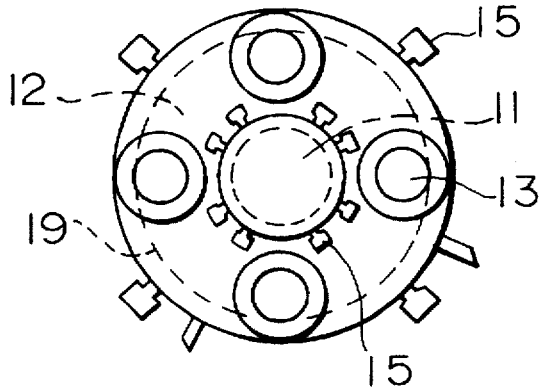
FIG. 3B PRIOR ART
FIG. 3B is a plan view of the conventional cupola of FIG. 3A.
Figure 4A:
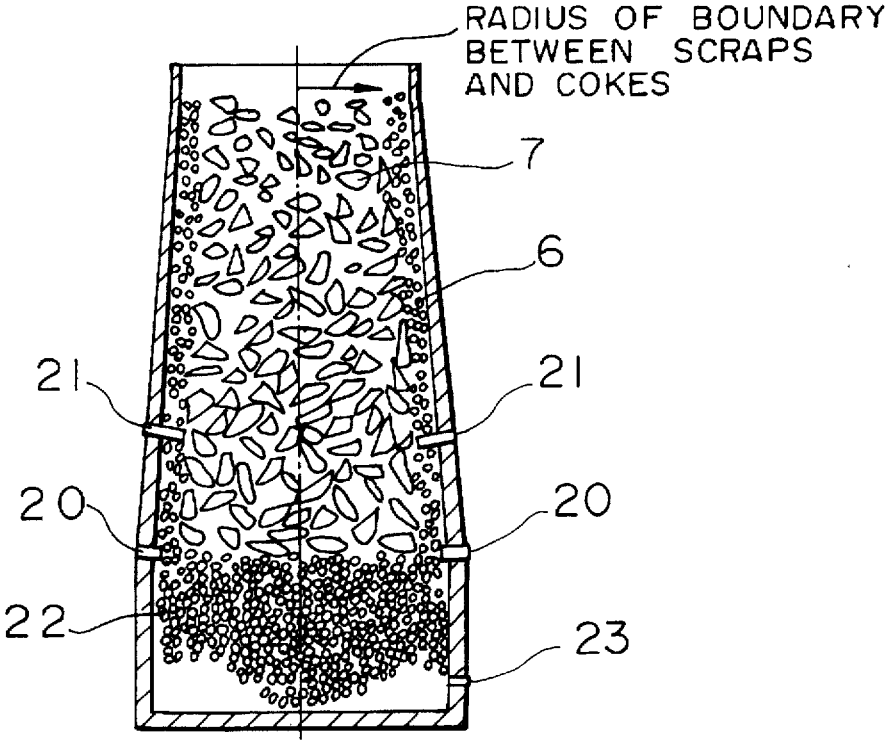
FIG. 4A PRIOR ART
FIG. 4A is a vertical sectional view of a cupola illustrative of conventional charging of a cupola.
Figure 4B:
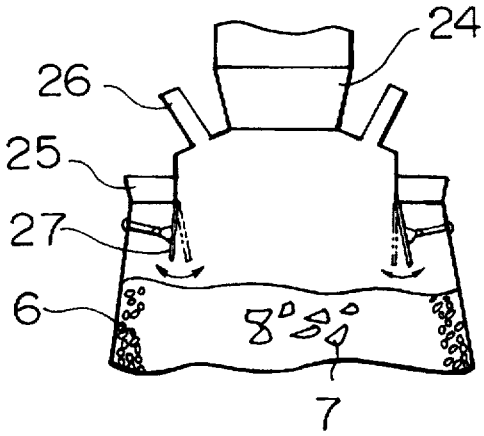
FIG. 4B PRIOR ART
FIG. 4B is a vertical sectional view of the structure adjacent the top portion of the conventional cupola of FIG. 4A.

Coke was charged into the bottom of the cupola up to a level 1.1 m above the primary blowing tuyere so as to form a coke bed on the hearth. Then, iron scrap and blast furnace coke were alternately charged through the charging pipe, whereby a distribution pattern as shown in FIGS. 2A to 2C was obtained in generally horizontal layers. The quantity Ws of the iron scrap per charge was controlled at 150 kg. The quantity of charging of the coke as the carbon source was determined to be 22 kg which was sufficient for melting the charged iron scrap to such an extent that the carbon content in the molten iron was 3.5 wt %.

Then, a second charge of iron scrap was executed, followed by charging of the blast furnace coke and limestone, and the described operation was repeated until the level of the top surface of the charged material reached 3.5 m above the primary blowing tuyeres.

A supply of air was conducted such that the total rate of oxygen supply both through the primary blowing tuyeres and secondary combustion tuyeres was set to 378 Nm$^3$/hr. More specifically, oxygen-enriched air having an oxygen content of 29% was blown through the primary blowing tuyeres, while ordinary air was supplied through the secondary combustion tuyeres, thus achieving a melting rate of 3 tons/hour.

Melting was thus started and continued while controlling the additional charges of the materials such that the top of the charged materials was maintained at a level falling within the range of 3.5±0.2 m.

Consequently, the melting operation was performed at a much higher coke consumption of 147 kg/ton, and the secondary combustion ratio as measured through the gas emanating from the top of the cupola was only 46%.

Comparative Example 2

20 tons of iron scrap were melted in a cupola having an inside diameter of 0.6 m and a melting capacity of 3 ton/hr. Iron scrap was shredded into grains or pieces of sizes ranging between 25 mm and 150 mm, while blast furnace coke of 30 to 75 mm was used as the carbon source. Thus, the sizes of the greatest grains or pieces of iron scrap were less than ⅓ the cupola inside diameter.

As the first step, coke was charged up to a level 1.1 m above the primary blowing tuyere 4 (FIG. 1A) so as to form a coke bed on the hearth. The charging pipe 2 was so adjusted as to position its lower end at a level of 0.6 m above the charged material surface. As described before in connection with a foregoing Example of the invention, equation (1) requires that the level of the lower end of the charging pipe shall be about 0.09 m or less. Thus, in Comparative Example 2, the condition of equation (1) was not met. The quantity Ws of the iron scrap per charge was set to 50 kg. The equation (2) requires that the quantity of iron scrap per charge should not be greater than about 25 kg. Thus, the condition of equation (2) also was not met. The, charging pipe 2 was elevated by 0.35 m and blast furnace coke as the carbon source and limestone as the slag former were charged through the elevated charging pipe 2. The quantity of charge of the coke as the carbon source was 7.2 kg which was sufficient for melting the charged iron scrap to such an extent that the carbon content in the molten iron was 3.5 wt %.

Then, a second charge of iron scrap was introduced, followed by charging of the blast furnace coke and limestone, and the sequential operation was repeated until the level of the top surface of the charged material reached 3.5 m above the primary blowing tuyeres.

Supply of air was conducted such that the total rate of oxygen supply both through the primary blowing tuyeres and secondary combustion tuyeres was 378 $Nm^3$/hr. More specifically, oxygen-enriched air having an oxygen content of 27% was blown through the primary blowing tuyeres, while ordinary air was supplied through the secondary combustion tuyeres, thus achieving a melting rate of 3 tons/hour.

Melting was thus started and continued while controlling the additional charges of the materials such that the top of the charged materials was maintained at a level falling within the range of 3.5±0.2 m. When the iron scrap was charged during the melting operation, the charging pipe was so adjusted as to set the lower end thereof at a level of 0.6 m, which does not meet the requirement of equation (1), whereas, when the coke was charged, the charging pipe was adjusted to locate its lower end at a level of 0.35 m.

Consequently, the melting operation was performed at a high coke consumption of 144 kg/ton, and the secondary combustion ratio as measured through the gas emanating from the top of the cupola was only 50%.

As will be understood from the foregoing description, according to the present invention, iron melting in a cupola can well be conducted at reduced coke cost as compared with the conventional art. Energy consumption is reduced enough to permit iron melting operation at high thermal energy efficiency, thus contributing to preservation of environmental conditions, saving of energy and reduction of steel production costs.

Although specific expressions have been used in this specification in the interest of clarity, it will be appreciated by those skilled in the art that excellent thermal efficiency can be achieved in the melting process without achieving precise demarcation between the zones of coke and of scrap, so long as a general congregation or segregation of scrap is caused to occupy a core portion and a general congregation or segregation of coke is caused to occupy a generally peripheral portion within the cupola. This is because the segregated masses surprisingly permit the melting operation to proceed at a radically reduced cost of coke and to achieve a remarkably high secondary combustion ratio in the cupola.

Further, while the presence of air-blowing tuyeres is of course beneficial in providing combustion-supporting air, the number of tuyeres and their particular location and disposition in the cupola can be varied without departing from the spirit of this invention. Variations may also be employed regarding the introduction of the iron scrap and the coke at or near the top of the cupola, or elsewhere.

It will further be appreciated that many other variations may be practiced, including use of certain features independently of others, reversals of method steps, and the substitution of equivalents for the steps described, all within the spirit and scope of the invention as defined in the appended claims.

What is claimed is:

1. A method of charging a cupola having air blowing tuyeres with materials so as to melt iron scraps, said method comprising:

providing a material charging pipe at the center of the top of said cupola, said material charging pipe having a lower end and defining a feeding location;

setting the level of said lower end of said material charging pipe to a height "h" which satisfies the following equation (1);

charging, through said charging pipe, iron scraps in a quantity Ws which satisfies the following equation (2);

charging coke through said charging pipe; and adjusting the level of said lower end of said charging pipe to conform to equation (1), charging of iron scrap and separately thereafter charging of coke, wherein equations (1) and (2) are:

$$h \leqq (r-r')\tan\theta \quad (1)$$

$$Ws \leqq \tfrac{1}{3}\cdot\pi r^3\cdot\tan\theta\rho_s \quad (2)$$

where, h designates the height of the lower end of said charging pipe above the surface of the material in said cupola, in meters r: inside radius of cupola, in meters r': inside radius of charging pipe, in meters θ: angle of repose of iron scrap, in degrees Ws: quantity of iron scrap per cycle, in kg/ch, and $\rho_s$: bulk specific gravity of iron scrap, in $kg/m^3$.

2. The method defined in claim 1, wherein said cupola has an inside diameter, and wherein said iron scrap and said coke have controlled grain sizes not greater than about ⅓ of the inside diameter of said cupola.

3. The method defined in claim 1, wherein, after introducing a charge of iron scrap into said cupola, said feed location is raised in an amount of r'tan θ, and wherein coke is charged into said cupola from said raised charging location.

* * * * *